United States Patent [19]

Remington

[11] 4,416,126

[45] Nov. 22, 1983

[54] LUGGAGE LATCHING SYSTEM

[75] Inventor: Richard C. Remington, Pompton Plains, N.J.

[73] Assignee: Presto Lock, Inc., Garfield, N.J.

[21] Appl. No.: 214,883

[22] Filed: Dec. 10, 1980

[51] Int. Cl.[3] ..... E05B 65/52; E05B 37/02

[52] U.S. Cl. ..... 70/71; 70/312; 70/316

[58] Field of Search ..... 292/26, 27, 29, 46, 292/47, 48, 49, 52, DIG. 72; 70/67, 69, 70, 71, 72, 73, 74, 75, 76, 312, 315, 316, 317, 318; 190/56

[56] References Cited

U.S. PATENT DOCUMENTS

| | | | |
|---|---|---|---|
| 2,163,852 | 6/1939 | Pond | 70/317 |
| 3,413,025 | 11/1968 | Sperry | 292/26 |
| 3,743,335 | 7/1973 | Reilher | 292/DIG. 72 |

*Primary Examiner*—Robert L. Wolfe

*Attorney, Agent, or Firm*—Shapiro and Shapiro

[57] ABSTRACT

A latching system for a luggage article in which an elongate latch console attaches interiorly to one section of the article for cooperation with a hasp assembly on another section of the article. The latch console includes a pair of left-hand latches which pivot in a counterclockwise direction from hasp-engaging to hasp-disengaging positions and a pair of right-hand latches which pivot in a clockwise direction from hasp-engaging to hasp-disengaging positions. Slide rods within the console are connected between the latches, and a central swiveling actuator moves the latches from their hasp-engaging to their hasp-disengaging positions responsive to movement from the actuator from a rest position. Springs return the latches, slide rods and actuator to their initial positions when the actuator is released. A combination lock is provided to lock the actuator in the rest position and the latches are mounted for movement independently of the slide rods when the hasps are disengaged to allow the hasps to be reengaged with the latches even when the actuator is locked.

35 Claims, 15 Drawing Figures

LUGGAGE LATCHING SYSTEM

BACKGROUND OF THE INVENTION

The invention relates to latching systems suitable for use on luggage articles, for example for releasably securing a body section of an article to a hinged lid and the like. The invention is particularly adapted for use on luggage of the soft-sided type in which the front walls of the respective body and lid sections, to which the latching system is fitted, are of a somewhat flexible nature. However, the invention may also be used in other applications.

Latching systems for use on luggage articles should fulfill a number of basic requirements. First and foremost, they must provide secure latching of the body section of the article to the lid. In this regard, it is common practice to provide at least two individual latching assemblies spaced along the front walls of the respective sections. Further, it is desirable for the individual assemblies to be operable in a simple manner. To this end, it is known to provide a common manual actuator for operating a number of latch devices in unison by means of linkage and drive arrangements connected between the actuator and the respective assemblies. Additionally, it may be desirable to provide some form of locking means for the latching system, for securing against unauthorized opening of the luggage article.

Other desirable characteristics for luggage-latching systems are, for example, that the system should be as compact as possible, so as not to intrude unduly into the interior of the luggage article, that it should be relatively economical to manufacture and simple to fit and that it should be capable, to a degree, of accommodating misalignments which may develop between parts of the sections being latched. The last of these characteristics is of particular relevance in systems intended for use on articles of the soft-sided type.

The present invention is intended to provide a latching system for a luggage article which, to the extent possible, incorporates a combination of the desired characteristics in a novel form of latching structure.

SUMMARY OF THE INVENTION

The concepts of the invention may conveniently be applied in a latching system having a number of spaced latches housed in a relatively flat elongate console arrangement for attachment to one section of a luggage article, the latches being adapted to engage fixed hasps attached to another section of the article.

In accordance with one aspect of the invention, the latching system may have a plurality of spaced latches, each mounted for pivotal movement between a hasp-engaging position and a hasp-disengaging position, a latch actuator, drive means connected between the actuator and each latch for moving the latches in unison between the hasp-engaging and hasp-disengaging positions responsive to movement of the actuator from a rest position, biasing means for returning the latches to their hasp-engaging positions upon release of the actuator and, through said drive means, for returning the actuator to the rest position, wherein each of the latches is movable from its hasp-engaging position to its hasp-disengaging position independently of the drive means when the latch is disengaged from a hasp, whereby the hasp can be re-engaged with the latch without having to move the actuator from the rest position.

In another of its aspects, the invention provides a luggage-latching system having a latch actuator, a first pair of spaced pivotal latches disposed on one side of the actuator for clockwise pivoting movement from hasp-engaging to hasp-disengaging positions, a second pair of spaced pivotal latches disposed on the other side of the actuator for counterclockwise pivoting movement between hasp-engaging and hasp-disengaging positions, drive means including first and second elongate slide means connected between the actuator and the respective pairs of latches for translating movement of the actuator from a rest position into movement of the latches from their hasp-engaging to their hasp-disengaging positions by longitudinal movement of the slide means, spaced latch-engaging elements on each slide means for moving the respective latches, and biasing means for returning the latches to their hasp-engaging positions upon release of the actuator and, through the slide means, for returning the actuator to the rest position.

The actuator may be of a swiveling type, operating the drive means through a camming member, and a combination lock may be provided for locking the actuator in the rest position. The lock may be of the pivotal bolt type in which an extension of the bolt engages and arrests the camming member, except when the lock is on combination, to prevent the actuator being moved from the rest position.

In accordance with a further aspect of the invention, a latch assembly for use in a luggage-latching system comprises a latch holder, a latch formed to engage a hasp, and means for pivotally mounting the latch in the holder selectively in one of two alternative positions by reversal of the latch, the latch when mounted in one position being pivotal in a clockwise direction from a hasp-engaging to a hasp-disengaging position and when mounted in the other position being pivotal in a counter-clockwise direction from a hasp-engaging position to a hasp-disengaging position.

Other aspects of the invention will be apparent from the following description and claims taken in conjunction with the attached drawings.

DESCRIPTION OF PREFERRED EMBODIMENT

Figure 1:
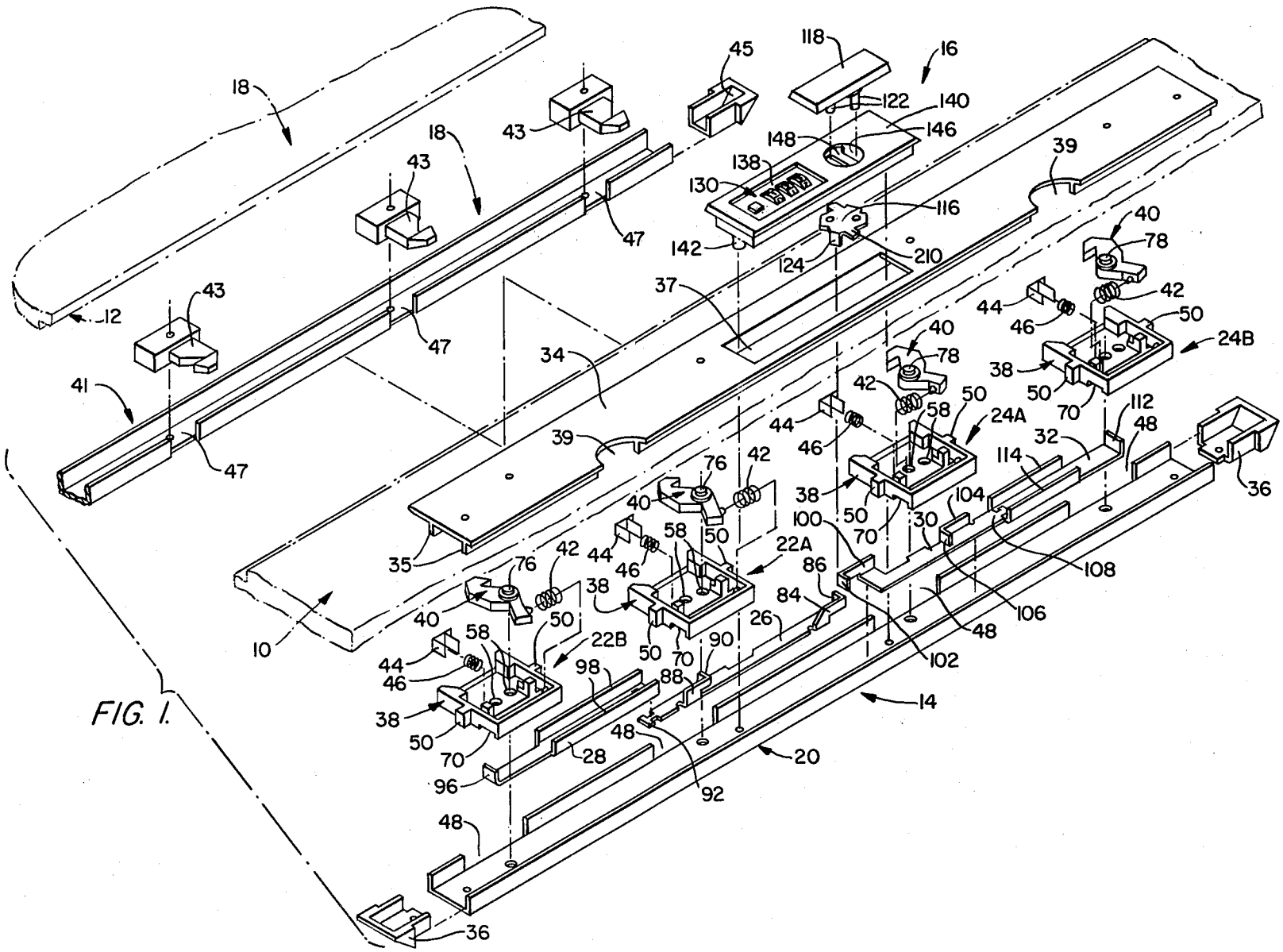
FIG. 1 is an exploded perspective view of a latching system in accordance with the invention, for use on a luggage article.

Referring initially to FIG. 1, the invention is illustrated as embodied in a latching system for a luggage article such as a soft-sided suitcase or the like. The case may, for example, have a body section with a somewhat flexible wooden front wall, part of the upper portion of which is shown in phantom at reference 10, and a hinged lid with a similar front wall, part of the lower portion of which is shown in phantom at reference 12. The latching system includes a relatively flat elongate latch console 14 for attachment interiorly to wall portion 10, a combined lock and actuator assembly 16 exposed on the exterior of wall portion 10 and a relatively flat elongate hasp assembly 18 for attachment interiorly to wall portion 12.

Latch console 14, illustrated in detail in FIGS. 1–5, includes a channel-shaped base plate 20; two left-hand latch assemblies 22A, 22B; two right-hand latch assemblies 24A, 24B; interfitting slide rods 26 and 28 forming drive means for operating the left-hand latch assemblies; similar interfitting slide rods 30 and 32, (colinear with slide rods 26 and 28) forming drive means for operating the right-hand latch assemblies; top plate 34, and end covers 36.

Each of the latch assemblies is made up of identical omponents, notably a latch holder 38, a pivotal latch 40, a latch spring 42, a hasp ejector 44, and an ejector spring 46. Holders 38 are of generally rectangular shallow box-like form having a depth substantially corresponding to the depth of base plate 20 and the holders fit in the base plate, being located by suitably spaced cutouts 48 in one upright wall of the base plate. Projections 50 on the sides of each holder fix the holder in position laterally of the base plate, with an upper portion of the holder protruding therefrom. Base plate 20 may, for example, be an extrusion of a metal, such as aluminum, and the holders may be plastic moldings.

Holders 38 each have a rear wall 52 (see FIGS. 3 and 4), a base wall 54, and side walls 56, and each holder is formed symmetrically about a center line extending transversely of base plate 20. On each side of the center line, the holder has a circular latch-receiving opening 58 in rear wall 52, and an ejector mounting plug 60. Side walls 56 each terminate in a head portion 62 providing ejector stop shoulders 64 and inclined hasp lead-in surfaces 66. At their lower ends, side walls 56 each have a locating projection 68 for latch spring 42. Rear wall 52 terminates at the bases of plugs 60 and side walls 56 have notches 70 (see FIG. 1) so that a transversely extending open channel or slot is formed at the base of the holder for receiving part of one of the slide rods 26-32, as will be described.

The latches 40 may be identical plastic moldings, each in the form of a crank having a notched latching portion 72 and an actuating portion 74. Between portions 72 and 74 the latch has a mounting section with bosses 76 and 78 on its opposite surfaces so that, by reversal of the latch, it may be pivotally mounted in either of the holder openings 58 by way of the respective bosses. On the actuating portion 74, the latch has a locating projection 80 for the latch spring.

Hasp ejectors 44 comprise yoke-like members adapted to fit over the respective plugs 60 with springs 46 interposed therebetween, so that the ejectors are urged toward shoulders 64. The ejectors have projecting hasp-engaging tongues 82 (see FIGS. 3 and 4).

In the left-hand latch assemblies 22A, 22B, latches 40 are mounted in holders 38 in the right-hand openings 58 for counterclockwise pivoting movement from the hasp-engaging positions (shown in FIG. 2) to the hasp-disengaging positions. The ejectors in these assemblies are fitted on the right-hand plugs 60 and hasp springs 42 are fitted between the latches and the right-hand projections 68 so as to bias the latches toward their hasp-engaging positions.

Figure 4:
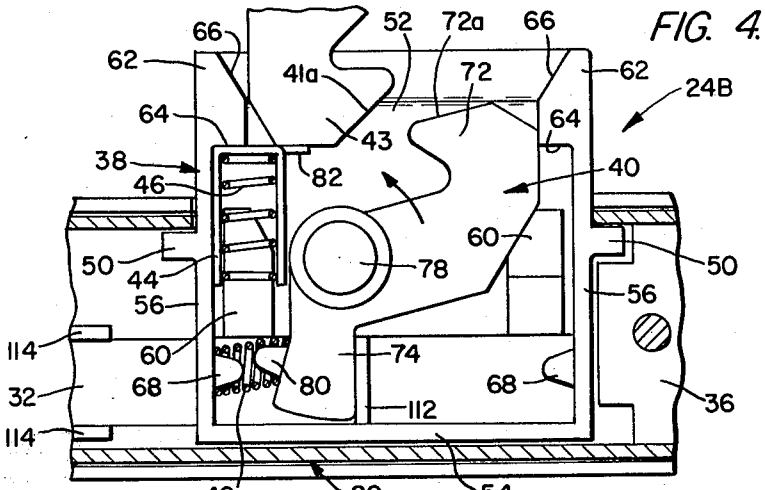
FIG. 4 is a view similar to FIG. 3 with the latch shown in its hasp-disengaging position.

In the right-hand latch assemblies 24A, 24B, on the other hand, latches 40 are reversed and mounted in holders 38 in the left-hand openings 58 for clockwise pivoting movement from the hasp-engaging positions (FIGS. 2 and 3) to the hasp-disengaging positions (FIG. 4). The ejectors in the right-hand assemblies are fitted on the left-hand plugs 60 and the hasp springs are located correspondingly.

Figure 2:
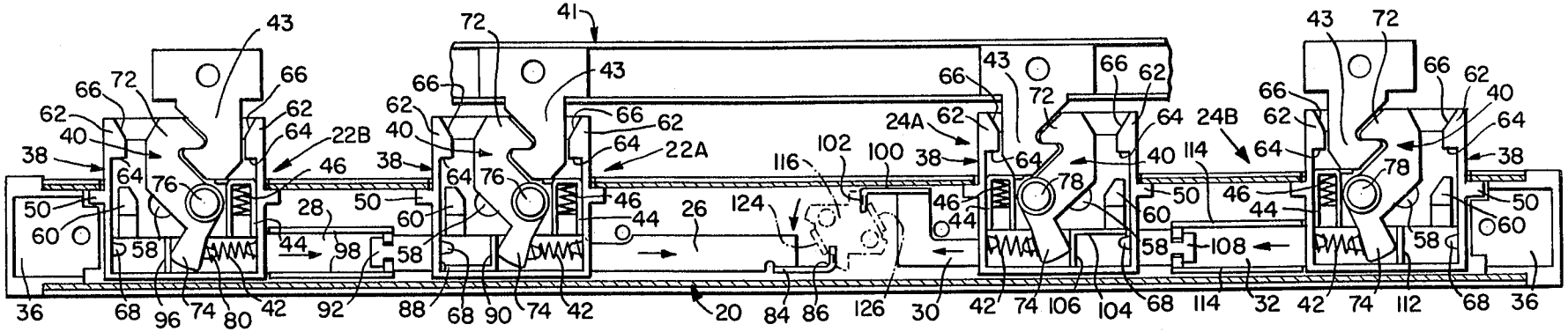
FIG. 2 is a sectional plan view of parts of the latching system.

Slide rod 26 has at its right end an up-turned projection 84 providing a transverse tab 86. Towards its left end, rod 26 has a further up-turned projection 88 providing a transverse tab 90, the length and configuration of the rod being such that projection 88 fits in the open channel of latch holder 38 of latch assembly 22A with tab 90 constituting a latch-engaging element engaging the actuating portion 74 of latch 40, as shown in FIG. 2. At its left end, rod 26 has a T-shaped coupling element 92 coupled with a complementary cutout at the right end of rod 28. Rod 28 terminates in an upstanding transverse tab 96 fitting in the open channel of holder 38 of latch assembly 22B and constituting a further latch-engaging element engaging the actuating portion of latch 40. Rod 28 has upstanding side walls 98 fitting between assemblies 22A and 22B and limiting longitudinal movement of rods 26 and 28.

Slide rod 30 has at its left end an upstanding projection 100 providing a transverse tab 102 and towards its right end a further upstanding projection 104 providing a transverse tab 106. Projection 104 fits in the open channel of holder 38 of latch assembly 24A with tab 106 constituting a latch-engaging element engaging behind the actuating portion of latch 40. At its right end, rod 30 has a T-shaped coupling element 108 coupled to a corresponding cutout in the left end of rod 32. Rod 32 at its right end has an upstanding transverse tab 112 fitting in the open channel of holder 38 of latch assembly 24B and forming a latch-engaging element engaging behind the actuating portion of latch 40. Rod 32 has upstanding side walls 114 fitting between latch assemblies 24A and 24B and limiting the longitudinal movement of rods 30 and 32.

Top plate 34 has depending side walls 35 (FIGS. 1 and 10) which interfit with the upstanding side walls of base plate 20 and the plates have corresponding openings whereby they are assembled together with suitable attachment means (not shown). Additionally, the top plate has a central rectangular opening 37 to accept the casing of the lock and actuator assembly 16 and cutouts 39 may be provided in the top plate, if required, to fit the terminal portions of a central carrying handle of the luggage article. The latch console may conveniently be supplied to a luggage manufacturer in a fully assembled state for direct attachment to the interior of the relevant wall section of a luggage article, with the lock and actuator assembly fitting into place from the exterior of the article. (The wall section of the article will have an opening corresponding to opening 37.) The end covers 36, which may be plastic moldings, fit in opposite ends of base plate 30 and may be secured by any suitable attachment means.

Hasp assembly 18 includes an elongate channel 41 and four identical reversible hasps 43 having notched portions complementary to the latch portions of latches 40. The hasps may also be plastic moldings. Channel 41 has cutouts 47 (FIG. 1) spaced to conform to the spacing of latches 40. The hasps are fastened in channels 41 by suitable fastening means and the two left-hand hasps are reversed with respect to the two right-hand hasps to complement the operation of the respective latches. End caps, as 45, are provided for the ends of channel 41. When the hasps are in engagement with the respective latches, i.e., the luggage article is closed, the hasps depress ejectors 44 by engagement with tongues 82 as shown in FIG. 2.

Tabs 86 and 102 of rods 26 and 30, respectively, engage a central camming member 116 connected to a swiveling actuator 118, the actuator and camming member forming part of assembly 16. Camming member 116 is attached to actuator 118 by fastening means, such as screws 120 (see FIGS. 6 and 7) received in depending actuator posts 122. The camming member has opposed downwardly extending tangs 124, 126 behind which tabs 86 and 102 engage (see FIGS. 2 and 6). Thus, when the camming member 116 is swiveled counterclockwise, by swiveling movement of the actuator from the rest position shown in FIGS. 2 and 6, rods 26 and 28 are drawn to the right while rods 30 and 32 are drawn colinearly to the left. The camming member thus constitutes a drive member for the slide rods and the tabs 86 and 102 form drive formations by which the rods are moved.

Movement of rods 26 and 28 to the right causes tabs 90 and 96 to effect counterclockwise pivoting movement of the left-hand latches 40 against the action of latch springs 42, while movement of rods 30 and 32 to the left causes tabs 106 and 112 to effect counterclockwise pivoting movement of the right-hand latches. The latches are thus moved from their hasp-engaging positions to their hasp-disengaging positions responsive to swiveling movement of the actuator from the rest position. FIG. 4 shows right-hand latch assembly 24B in the hasp-disengaging position and it will be seen that the right-hand plug 60 and head portion 62 provide stop surfaces for the latch. Further, release of the latches from the hasps causes the ejectors to urge the hasps outwardly with respect to the holders (FIG. 4) thereby facilitating opening of the luggage article.

When actuator 118 is released, the latch springs 42 act as biasing means which return the latches to their respective hasp-engaging positions and, through tabs 90, 96, 106 and 112 return the slide rods to their initial positions. Tabs 86 and 102 acting on tangs 124 and 126 return the camming member 116 and the actuator 118 to the rest position.

Figure 3:
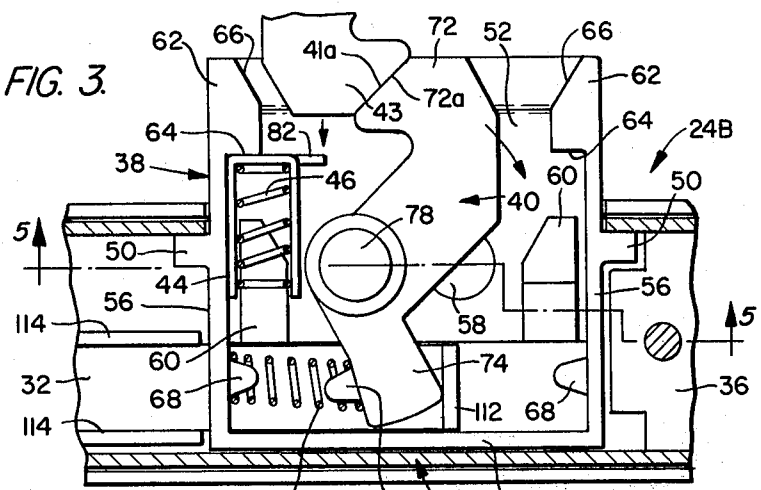
FIG. 3 is a sectional plan view, on an enlarged scale, of one of the latch assemblies and hasps of the latching system, with a latch shown in its hasp-engaging position.
Figure 5:
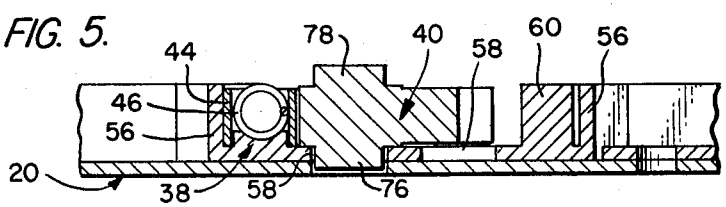
FIG. 5 is a sectional view on line 5—5 of FIG. 3.

It will be appreciated, as seen particularly in FIG. 3, that when the hasps are disengaged, the latches can be pivoted against springs 42 away from their hasp-engaging positions independently of the slide rods. Thus, downward pressure exerted on inclined surfaces **72*a* of the illustrated latch by the inclined hasp surface 41*a* produces a camming action, pivoting the latch away from the hasp-engaging position and allowing the hasp to be re-engaged without having to move the actuator and slide rods from their rest positions. When the surface 41*a* clears surface 72*a*, the latch is snapped back into hasp engagement by spring 42**. The design of the hasps and latches and the specific angles of the respective camming surfaces (preferably about 45° in each case) facilitates closing of the case even if there are slight misalignments between the respective hasps and latches.

Figures 6, 7, 7A, 8, 9:
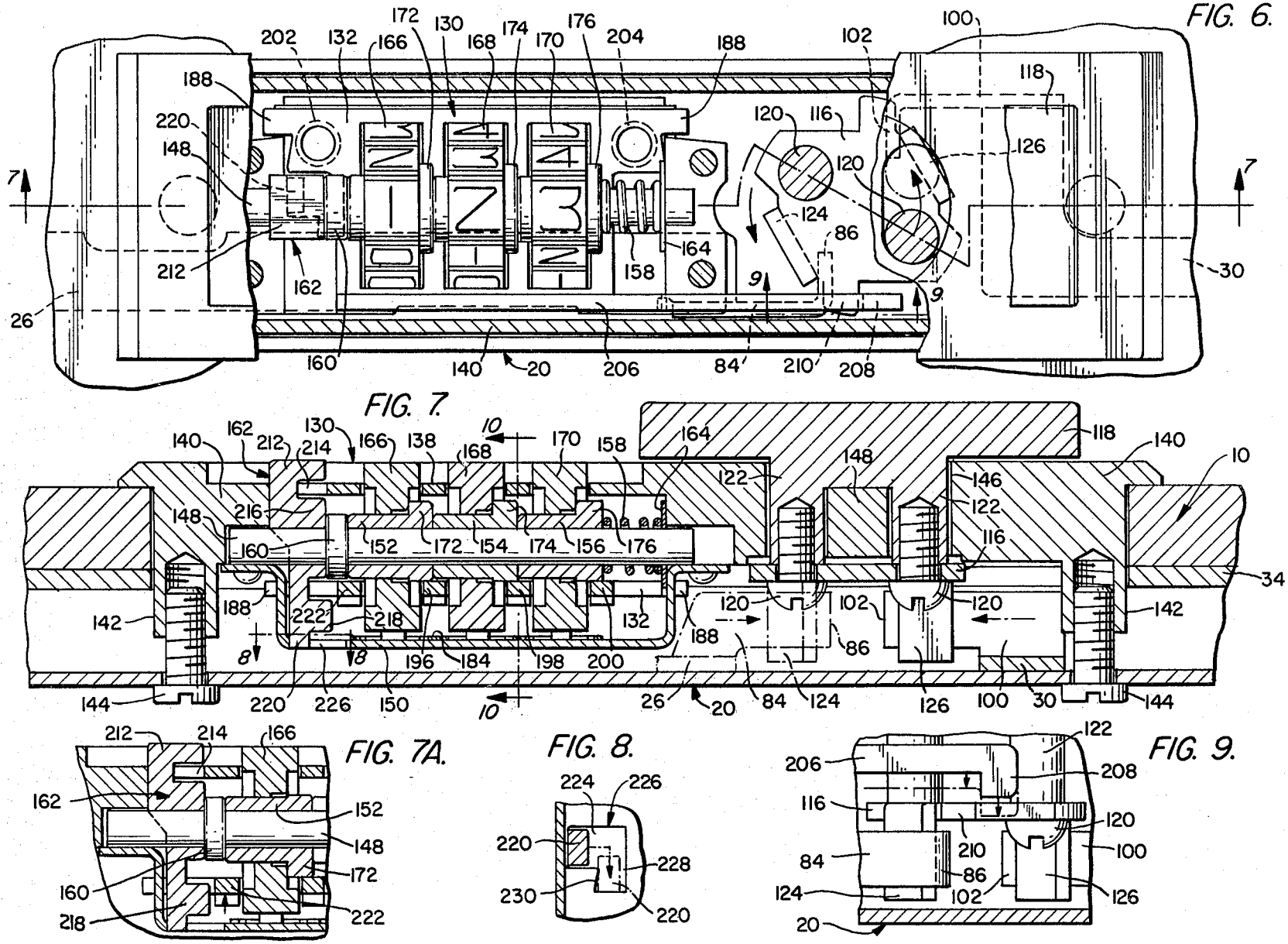
FIG. 6 is a sectional plan view, part broken away, of a combination lock and camming member used in the latching system.
FIG. 7 is a sectional view on line 7—7 of FIG. 6 with the lock shown in the unlocked condition.
FIG. 7A is a view similar to FIG. 7 showing parts of the lock in the locked condition.
FIG. 8 is a sectional view on line 8—8 of FIG. 7.
FIG. 9 is a sectional view on line 9—9 of FIG. 6.

Actuator and lock assembly 16 includes a body member 140 which, as previously indicated, fits in opening 37 in the top plate of the latch console, through a corresponding opening in wall 10 of the luggage article (see FIG. 7). Body member 140 includes depending posts 142 by which it may be attached to base plate 20, by screws 144, or other suitable fastening means may be used. The body member further includes an opening 146 in which actuator 118 is rotatably mounted and the body member also forms part of a housing for a combination lock 130. Opening 146 includes a cross member 148 straddled by actuator posts 122, thereby limiting swiveling movement of the actuator, and the camming member 116 prevents the actuator from being withdrawn upwardly from opening 146.

When fitting the latch console and assembly 16 to a luggage article, for example, the latch console may be attached to the interior of the relevant wall section of the article and assembly 16 may then simply be fitted into place from the exterior of the article through opening 37, the slide rods and camming member being suitably adjusted such that tabs 86 and 102 interfit behind the tangs 124 and 126. Assembly 16 may then be fixed in place by the aforementioned screws 120 or the like.

Combination lock 130 (see particularly FIGS. 7–14) is adapted to releasably lock the actuator 118 and camming member 116 in the rest position, so that when the luggage article is closed, the latches cannot be disengaged from the hasps unless the lock is released. Lock 130 is of the type in which dial-driven cams control the movement of a movable locking member, in the form of a pivotal bolt 132, between locking and unlocking positions. In the locking position, the bolt blocks movement of camming member 116, as will be described, and in the unlocking position it releases the camming member for operation by the actuator. Lock 130 may conveniently be of a similar type to locks described in copending U.S. patent application Ser. No. 033,540 to Remington, filed Apr. 26, 1979 and commonly assigned herewith. The entire disclosure of the copending application is incorporated herein by reference.

Lock 130 includes a shaft 148 supported at its opposite ends between suitably shaped surfaces of body member 140 and a dished cover plate or baseplate 150 suitably secured by screws, rivets or the like to the body member. Combination sleeves 152, 154, 156 are rotatably mounted on shaft 148 between a coil spring 158 and an integral shaft collar 160. On the other side of collar 160 the shaft carries a shift lever 162, and spring 158 engages a washer 164 to urge the assembly of shaft, sleeves and shift lever to the left, as shown in the drawings.

Figure 14:
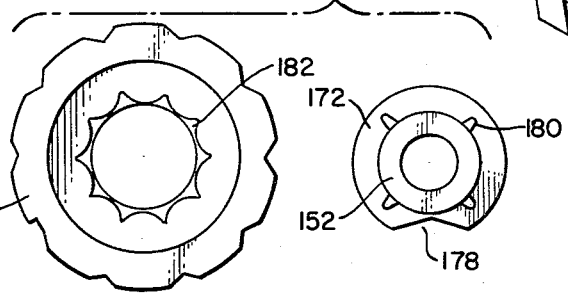
FIG. 14 is a composite end view of a combination dial and combination sleeve.

Sleeves 152–156 carry encircling combination dials 166, 168, 170 and the sleeves have enlarged end flanges 172, 174, 176 constituting cams for the lock bolt, as will be described. The periphery of each cam is circular except for a substantially V-shaped notch 178, as shown in FIG. 14. The sleeves are coupled for rotation to the respective dials in conventional manner by teeth 180 on the sleeves which mesh with corresponding openings 182 in the dials. The dials have conventional circumferentially disposed indicia, with portions of the dials protruding through suitable slots in a portion 138 of body member 140 constituting the lock faceplate, for manual rotation of the dials and sleeves. A dial spring 184 on the cover plate 150 has arms 186 (FIG. 10) engaging detents between the respective dial indicia, so that the dials are rotated in equal increments between successive indicium-displaying positions.

The lock bolt 132 has projecting tongues 188 by which the bolt is pivotally mounted in suitable openings (not shown) in cover plate 150. Openings 190, 192, 194 in the bolt (see FIG. 12) accommodate the respective dials and the bolt has cross-bars 196, 198, 200 positioned to engage against the peripheries of cams 172–176, respectively. The bolt is urged upwardly into engagement with the cam peripheries by coil springs 202, 204 (see FIGS. 6 and 10).

Figure 10:
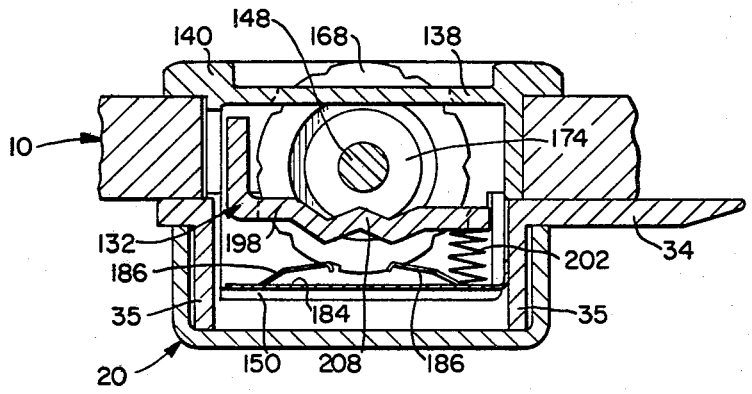
FIG. 10 is a sectional view on line 10—10 of FIG. 7.
Figure 12:
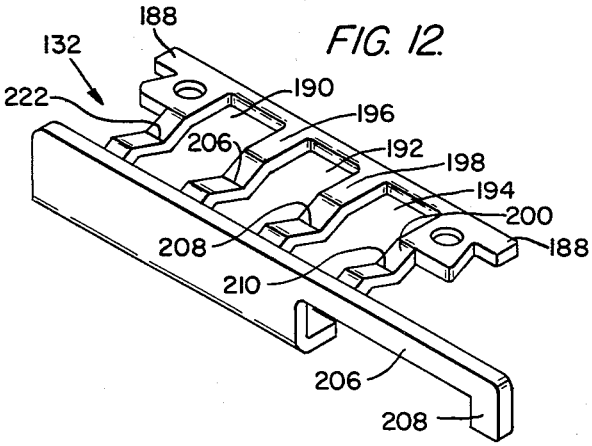
FIG. 12 is a perspective view of the lock bolt.
Figure 13:
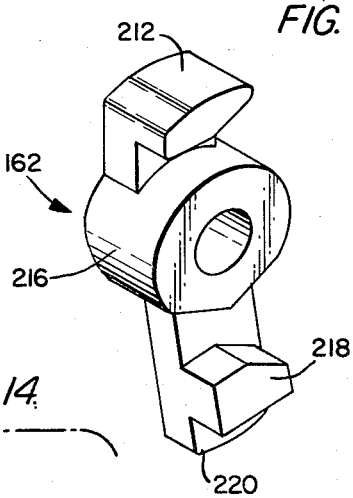
FIG. 13 is a perspective view of the lock shift lever.

As seen particularly in FIGS. 10 and 12, cross-bars 196–200 of the bolt are shaped to provide ridge portions 206, 208, 210, having converging planar surfaces. When all the sleeves 152–156 are rotated into a particular alignment, as shown in FIG. 10, corresponding to particular indicium-displaying positions of the respective dials (i.e., the on-combination setting of the lock), the ridge portions engage in the respective cam notches 178 and the bolt assumes an upper unlocked condition under the influence of springs 202, 204. When, however, any one or more of the dials is rotated by one or more increments from the aligned position, to move the lock off-combination, a camming action is effected between the respective notch and ridge portion whereby the bolt is moved down against springs 202, 204 into a locked position in which the relevant ridge portion is disengaged from the respective notch and brought into tangential contact with the dial periphery.

Specific design requirements for the notches and ridge portions and the advantages obtained with this type of construction are referred to in greater detail in the copending application referred to above.

Bolt 132 includes an elongate extension arm 206 extending through a suitable vertical slot (not shown) in cover plate 150 and terminating in a depending tab 208 adapted to cooperate with a corresponding tab projection 210 on camming member 116 (see FIGS. 6 and 9). When the bolt 132 is in its lowered, locked position, tab 208 engages behind projection 210 and prevents member 116 from being rotated by actuator 118 to operate the latching system. When, however, the bolt 132 assumes its upper unlocked position (the lock having been set on-combination) tab 208 clears projection 210 as seen in FIG. 9, and camming member 116 is freed for rotation by the actuator to operate the latching system.

Lock 130 further includes means for changing the set combination by moving the dials out of engagement with the respective sleeves and allowing the dials to be rotated relative to the sleeves. To this end, when the lock is set on-combination, shaft 148 and sleeves 152–156 can be moved to the right against spring 158 by means of shift lever 162, from the FIG. 7 position into a combination-changing position shown in FIG. 11, thereby uncoupling the sleeves from the dials.

Shift lever 162 includes a manual actuating portion 212 projecting through an opening 214 in the lock faceplate, a body portion 216 abutting shaft collar 160, a blocking portion 218 and a follower 220. When the lock bolt 132 is in its lowered, locked position, blocking portion 218 is in blocking alignment with cross member 222 of the bolt (FIG. 7A) thereby preventing the shift lever from being moved to the right. When the lock is set on-combination, however, and the bolt is lifted, cross member 222 clears blocking portion 218 (FIG. 7) and allows the manual actuating portion 212 of the shift lever to be moved to the right in opening 214. This movement causes the assembly of shaft 148 and sleeves 152–156 to be moved into the FIG. 11 position against spring 158.

Figure 11:
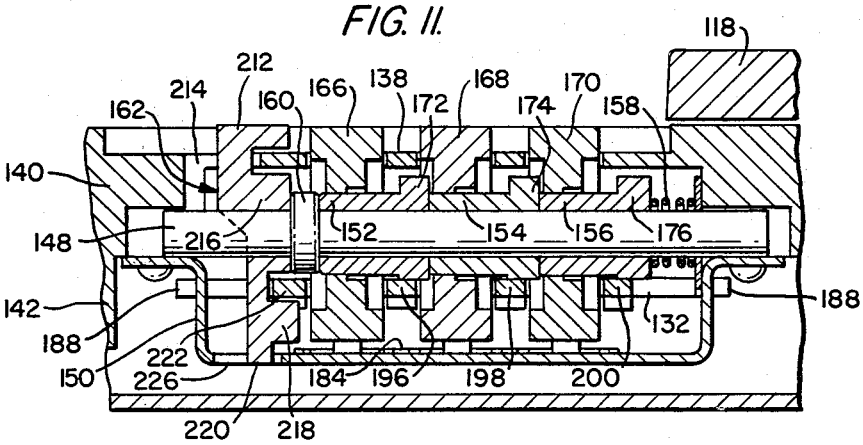
FIG. 11 is a view similar to FIG. 7 showing parts of the lock in a combination-changing position.

Movement of the shift lever 162 to the right causes follower 220 to move along one leg 224 of an L-shaped guide opening 226 in cover plate 150 (see FIG. 8). In the FIG. 11 position, the shift lever can then be tilted on shaft 148 so that the follower 220 engages the other leg 228 of opening 226 behind a stop shoulder 230. The shift lever can then be released and the stop shoulder holds the shaft and sleeves in the combination-changing position. Further, in the combination-changing position, blocking portion 218 of the shift lever engages under cross member 222 of the bolt as seen in FIG. 11. This holds the bolt in the upper unlocked position, thereby precluding rotation of the sleeves and avoiding a loss of combination.

When the combination has been changed, shift lever 162 can be tilted back into its initial orientation on shaft 148 to bring follower 220 out of engagement with shoulder 230. Release of the shift lever then allows spring 158 to return the shaft, sleeves and shift lever to the FIG. 7 position, thereby re-coupling the dials and sleeves and setting the new combination.

It will be seen from the foregoing that the invention provides a latching system suitable for a luggage article, which is simple to mount, by attaching the latching console and hasp assembly to the interior of the respective wall sections and securing the lock and actuator assembly in place on the exterior of the article. The system uses a single central actuator for operating a series of latches in unison and can be readily locked and unlocked by means of a central lock operatively connected with the actuator. Since the latches can be moved independently of the actuator, the luggage article can be closed even when the actuator is locked. Further, since both the left-hand and right-hand latch assemblies are constituted by identical components, the system lends itself to economies in manufacture.

While only a single preferred embodiment of the invention has been described herein in detail, the invention is not limited thereby and modifications can be made within the scope of the attached claims. For example, different locking arrangements may be used in place of the described combination lock for locking the actuator in the rest position.

I claim:

1. A latching system for a luggage article including a plurality of spaced latches each mounted for movement between a hasp-engaging position and a hasp-disengaging position, a latch actuator, drive means connected between said actuator and each latch for moving the latches in unison from their respective hasp-engaging to their respective hasp-disengaging positions responsive to movement of the actuator from a rest position, biasing means for returning said latches to the respective hasp-engaging positions upon release of the actuator and, through said drive means, for returning the actuator to the rest position, each of said latches being movable from its hasp-engaging position to its hasp-disengaging position independently of the drive means when the latch is disengaged from a hasp whereby the hasp may be reengaged with the latch while the actuator is retained in the rest position.

2. A system as defined in claim 1, wherein said latches each include a latching portion and an actuating portion extending from a latch-mounting section, said drive means including latch-engaging elements operative on the actuating portions of the respective latches for pivoting the latches from their hasp-engaging to their hasp-disengaging position responsive to sliding movement of the drive means, the actuating portion of each latch being movable away from the associated latch-engaging element during re-engagement of a hasp with the latch and the biasing means returning the actuating portion into operative engagement with the latch-engaging element when the hasp is re-engaged with the latch.

3. A system as defined in claim 2, wherein the biasing means includes spring means associated with the actuating portion of each latch.

4. A system as defined in claim 2, wherein the latching portion of each latch includes a surface for providing a camming action with an associated hasp during re-engagement of the hasp with the latch, said camming action being effective to pivot the latch away from its hasp-engaging position accompanied by movement of the actuating portion of the latch away from the associated latch-engaging element.

5. A system as defined in claim 1, wherein the latches are mounted on opposite sides of the actuator respectively for pivotal movement in opposite directions from their hasp-engaging to their hasp-disengaging positions, and wherein the drive means includes a slide rod for each latch, the slide rods being movable in opposite directions respectively responsive to movement of the actuator from the rest position, for moving the latches from their hasp-engaging to their hasp-disengaging positions.

6. A system as defined in claim 5 including a camming member connected between the actuator and each of the slide rods for moving the slide rods in opposite directions, respectively, responsive to movement of the actuator from the rest position, each slide rod including a latch-engaging element for moving the respective latch from its hasp-engaging to its hasp-disengaging position responsive to actuator-induced movement of the slide rod while permitting independent hasp-induced movement of the latch from the hasp-engaging position.

7. A system as defined in claim 6, wherein the slide rods are disposed colinearly on opposite sides of said camming member respectively and are movable colinearly in opposite directions respectively responsive to movement of the actuator from the rest position.

8. A system as defined in claim 1 including ejector means for urging a hasp away from a latch responsive to actuator-induced movement of the latch from its hasp-engaging position.

9. A system as defined in claim 1 including a lock for locking the actuator in the rest position.

10. A system as defined in claim 9, wherein the lock comprises a combination lock including a locking member movable between an unlocking position and a locking position, the locking member being effective to prevent movement of the actuator from the rest position when the locking member is in the locking position and to release the actuator when the locking member is in the unlocking position and dial-driven cams for controlling the position of the locking member.

11. A system as defined in claim 10, wherein the locking member is a pivotal bolt having an extension adapted to engage and disengage a member connected between the actuator and the drive means when the bolt is in the locked and unlocked positions, respectively.

12. A latching system for a luggage article comprising an elongate substantially planar latch console for attachment interiorly to one wall of the article, and a latch actuator assembly, the latch console including a base plate, a cover plate connected to the base plate, a pair of spaced latches mounted between the plates for movement between latching and unlatching positions and drive means between the plates for moving the latches between the latching and unlatching positions, the actuator assembly including a manual actuator and a drive member connected with the actuator for operating the drive means, the actuator assembly being adapted to fit in an opening in said wall of the article with the actuator exposed on the exterior of said wall and with the drive member being engageable with said drive means through an opening in the cover plate.

13. A latching system as defined in claim 12, wherein the drive means includes a slide rod for each latch, the slide rods terminating in drive formations between the latches and wherein the drive member comprises a swiveling camming member adapted to engage said drive formations and move the drive rods in opposite directions, respectively, responsive to swiveling movement of the actuator from a rest position.

14. A latch assembly for a luggage-latching system including a latch holder, a latch formed to engage and disengage a hasp, and means for pivotally mounting said latch in said holder selectively in one of two alternative positions by reversal of the latch, the latch when mounted in one of said positions being pivotal in a clockwise direction from a hasp-engaging position to a hasp-disengaging position and the latch when mounted in the other of said positions being pivotal in a counterclockwise direction from a hasp-engaging position to a hasp-disengaging position.

15. An assembly as defined in claim 14, wherein the latch is in the form of a crank including a central mounting section having opposed bosses on opposite surfaces thereof for mounting the latch in said alternative positions in the holder, the crank further including a latching portion and an actuating portion, the latching and actuating portions extending from the mounting section.

16. An assembly as defined in claim 15, wherein the holder is formed symmetrically about a center line and has an opening on each side of said center line for pivotally mounting one or other of said latch bosses.

17. An assembly as defined in claim 16, wherein the holder includes on each side of said center line a plug for mounting a hasp ejector and means providing an ejector stop.

18. An assembly as defined in claim 17, wherein the holder further includes on each side of said center line means for locating a spring adapted to engage said actuating portion of the latch for urging the latch towards a hasp-engaging position.

19. An assembly as defined in claim 16, wherein the holder includes a rear wall defining said openings, and side walls, said rear wall and side walls defining an open channel extending transversely of said center line for receiving a drive element for pivotally moving the latch from a hasp-engaging to a hasp-disengaging position.

20. An assembly as defined in claim 14, wherein said latch and said holder each comprise a plastic molding.

21. A latching system for a luggage article including a latch actuator, a first pair of spaced pivotal latches disposed on one side of the actuator for clockwise pivoting movement from hasp-engaging to hasp-disengaging positions, a second pair of spaced pivotal latches disposed on the other side of the actuator for counterclockwise pivoting movement from hasp-engaging to hasp-disengaging positions, first and second elongate slide means connected between said actuator and the respective pairs of latches for translating movement of the actuator from a rest position into movement of the latches from their hasp-engaging to their hasp-disengaging positions by longitudinal movement of the slide means, spaced latch-engaging elements on each slide means for moving the respective latches from their hasp-engaging to their hasp-disengaging positions and biasing means for returning the latches to their hasp-engaging positions upon release of the actuator and for returning the actuator to the rest position.

22. A system as defined in claim 21, wherein the latches are mounted for movement away from their hasp-engaging positions independently of the slide means.

23. A system as defined in claim 22 including a camming member connected between the actuator and terminal portions of each slide means for translating swiveling movement of the actuator into movement of the respective slide means in opposite directions to move the latches from their hasp-engaging to their hasp-disengaging positions.

24. A system as defined in claim 23 including a lock operative on said camming member for locking the actuator against movement from the rest position.

25. A system as defined in claim 24, wherein said lock comprises a combination lock including dial-driven cams controlling the position of a locking member as between a locking position in which the locking member holds the camming member against rotation and an unlocked position in which the locking member releases the camming member.

26. A system as defined in claim 25, wherein said locking member comprises a pivotal bolt having an extension adapted to engage and release the camming member in the locked and unlocked positions of the bolt, respectively.

27. A latch console for a luggage article latching system including an elongate base plate, a plurality of box-like latch holders mounted on said base plate in longitudinally spaced relation, a latch mounted in each of said holders for pivoting movement between a hasp-engaging position and a hasp-disengaging position, each latch having a latching portion protruding from said base plate when the latch is in its hasp-engaging position and slide means extending longitudinally of the base plate for operating the latches, the slide means including latch-engaging elements received in the respective holders.

28. A latch console as defined in claim 27, wherein the latches are each mountable in their respective holders in one of two alternative positions, by reversal of the latch, the latch in one of said positions being pivotal in a clockwise direction from a hasp-engaging position to a hasp-disengaging position and in the other of said positions being pivotal in a counterclockwise direction from a hasp-engaging to a hasp-disengaging position.

29. A latch console as defined in claim 28 including a first pair of adjacent latches mounted in their respective holders for clockwise pivoting movement from hasp-engaging to hasp-disengaging positions, a second pair of adjacent latches mounted in their respective holders for counterclockwise pivoting movement from hasp-engaging to hasp-disengaging positions, first longitudinal slide means for the first pair of latches and second longitudinal slide means for the second pair of latches.

30. A latch console as defined in claim 29, wherein the slide means each terminate in a drive formation located between the first and second pairs of latches whereby the drive slide means can be operated by a single central actuator.

31. A latch console as defined in claim 27 including biasing means in the respective holders urging the latches towards their hasp-engaging positions, the latches being movable away from their hasp-engaging positions independently of said slide means.

32. A combination lock comprising a plurality of dial-driven sleeves mounted in axially abutting relation on a shaft for controlling a locking member dependent on the rotational position of the sleeves, the sleeves normally being coupled to the respective dials, and means for enabling the combination of the lock to be changed by uncoupling the sleeves from the dials, said means including a shift lever positioned adjacent an end one of the sleeves for moving the sleeves axially to uncouple them from the dials by movement of the shift lever in one axial direction, the shift lever having an actuating portion at one end by which the shift lever can be moved manually, the actuating portion being adapted to project through an opening in a faceplate of the lock adjacent further openings in the faceplate through which portions of the respective dials project, and the shift lever further having a follower at its opposite end received in a guide opening provided in a baseplate of the lock, the guide opening allowing the shift lever to be tilted when the sleeves are uncoupled from the dials and holding the shift lever, when tilted, against movement in the opposite axial direction.

33. A lock as defined in claim 32, wherein the shift lever includes a blocking portion adapted to cooperate with the locking member for preventing the shift lever from being moved in said one axial direction to move the sleeves out of engagement with the dials except when the locking member is in an unlocked condition.

34. A lock as defined in claim 33, wherein in the tilted position of the shift lever, the blocking portion holds the locking member in the unlocked condition.

35. A lock as defined in claim 32, wherein the shift lever is mounted on the shaft.

* * * * *